US005301611A

United States Patent [19]

Derivi

[11] Patent Number: 5,301,611

[45] Date of Patent: Apr. 12, 1994

[54] METHOD OF DRIVING THE IMPRESSION CYLINDER RECEIVING CARRIAGES INTO THE PRINTING ELEMENTS OF A ROTARY PRINTING MACHINE

[75] Inventor: Ezio Derivi, Ivrea, Italy

[73] Assignee: Officine Meccaniche Giovanni Cerutti S.p.A., Italy

[21] Appl. No.: 950,819

[22] Filed: Sep. 24, 1992

[30] Foreign Application Priority Data

Sep. 27, 1991 [IT] Italy ..... MI91A-002588

[51] Int. Cl.[5] ..... B41L 3/02; B41F 5/00; B41F 9/00

[52] U.S. Cl. ..... 101/486; 101/216; 101/153; 101/247; 101/DIG. 35

[58] Field of Search ..... 101/486, 212, DIG. 35, 101/DIG. 36, 216, 219, 152, 153, 178-182, 247

[56] References Cited

U.S. PATENT DOCUMENTS

| | | | |
|---|---|---|---|
| 3,625,145 | 12/1971 | Heatley, Jr. | 101/216 |
| 3,783,782 | 1/1974 | Hardt | 101/216 |
| 4,449,450 | 5/1984 | Barny et al. | 101/216 |
| 4,502,384 | 3/1985 | Habluetzel | 101/153 |
| 4,989,514 | 2/1991 | Schiavi | 101/216 |
| 5,060,569 | 10/1991 | Gladow | 101/216 |

*Primary Examiner*—Eugene H. Eickholt
*Attorney, Agent, or Firm*—Kirschstein et al.

[57] ABSTRACT

A method of driving the impression cylinder receiving carriages into the printing elements of a rotary printing machine whilst executing a simultaneous displacement of all the impression cylinder receiving carriages provided in the printing elements and of all the impression cylinder receiving carriages arranged in a waiting position in front of the printing elements, the displacement movement taking place in a first direction of advance and, for the subsequent driving-in of the impression cylinder receiving carriages, the latter being displaced simultaneously and together with the carriages located in the printing elements in the opposite direction.

1 Claim, 6 Drawing Sheets

METHOD OF DRIVING THE IMPRESSION CYLINDER RECEIVING CARRIAGES INTO THE PRINTING ELEMENTS OF A ROTARY PRINTING MACHINE

BACKGROUND OF THE INVENTION

1. Field of the Invention

The abovementioned invention relates to a method, with which it is possible to drive impression cylinder receiving carriages into the printing elements automatically.

2. Description of Related Art

It is known that rotary printing machines consist of a series of printing elements which are arranged with mutual spacing and are fitted with known mechanical equipment which allows the web of paper to be printed to be moved through a multiplicity of successively arranged printing elements. Each of these printing elements has in a known manner a pressing roller which has the task of pressing the web of paper against an impression cylinder. Each impression cylinder is mounted in its own receiving carriage and each receiving carriage has a known squeegee device and an ink application device.

It is known that, when the printing programme is changed if, for example, a change is made from printing a particular product to printing a different product, it is necessary to stop the rotary printing machine in order to allow the individual impression cylinder receiving carriages to be driven out of the printing elements. Subsequently, the impression cylinder receiving carriages which are no longer to be used must be transported away from the associated printing element and only then is it possible to drive new impression cylinder receiving carriages into the gaps provided between the printing elements in order subsequently to drive the receiving carriages with the new cylinders into the printing units in order to start up the printing operation of the new product after carrying out the operations previously described.

Considering the fact that the investments to be made for a printing machine are very great, it is understandable that a printing works will strive to reduce the stoppage times of the machine to a minimum, that is to say those stoppage times required for exchanging the impression cylinder receiving carriages, an operation which even today is still largely carried out by hand.

An apparatus has been disclosed by the prior art, in which a transporting device is provided coaxially with the printing elements, on which transporting device the impression cylinder receiving carriages are arranged in order to drive the carriages from a waiting position into the gap between two printing elements in each case and subsequently to drive the corresponding impression cylinder receiving carriage into the printing element.

If the impression cylinders are to be exchanged by new cylinders, the cylinders are pushed through the individual printing units in order to occupy the adjacent gap between two printing elements and subsequently deposited on the transporting device again by a transverse movement.

This known apparatus has the disadvantage that it is necessary to provide a deep channel in the longitudinal direction of the rotary printing machine, which channel is suitable for receiving the components for the transporting device of the impression cylinder receiving carriages.

The necessity of providing a channel which extends over the entire length of the rotary printing machine entails considerable disadvantages and often cannot be accomplished for technical reasons, for example if the rotary printing machine is mounted on a floor which may not be changed.

A rotary printing machine has also been disclosed, in which the attempt has been made to reduce the stoppage times for exchanging the impression cylinder receiving carriages by providing for each printing element a twin-design impression cylinder receiving carriage, that is to say a receiving carriage which is constructed for receiving two impression cylinders, two squeegee devices and two corresponding ink application devices.

The disadvantage of this embodiment is to be seen in the fact that, for driving an impression cylinder receiving carriage of double width into the gap between two printing elements, said gap must be doubled in its dimensions, which leads to the overall length of the rotary printing machine increasing in an undesirable manner.

Furthermore, when using receiving carriages for two impression cylinders, a certain inertia is found in the displacement movement, which inertia does not allow the impression cylinder receiving carriage which is just in the waiting position to be exchanged, if required, by another impression cylinder receiving carriage which is fitted with a different impression cylinder.

A further disadvantage is to be seen in the fact that the receiving carriages for two impression cylinders are very heavy and consequently a great amount of force is required for moving these impression cylinder receiving carriages.

SUMMARY OF THE INVENTION

The object of the abovementioned invention is to avoid the disadvantages of the prior art and to propose a method in which it is possible to dispense with a transporting device for the impression cylinder receiving carriages and consequently also with a corresponding receiving channel for this transporting device and to provide the possibility of keeping an impression cylinder receiving carriage in a waiting position whilst providing a limited gap between two printing elements in each case and, as a result, to restrict the length of the overall rotary printing machine to a minimum and, at the same time, to open up the possibility of carrying out the exchange of the impression cylinder receiving carriages in a simple manner and in a short time. According to the invention, this object is achieved by a method which is characterised in that simultaneous displacement of all the impression cylinder receiving carriages (A1) located in the printing elements (1, 2, 3) together with all the impression cylinder receiving carriages (B1) which are in a waiting position between the corresponding printing elements (1, 2, 3) takes place in a direction (f) of advance, and in that, for the subsequent exchange of the impression cylinder receiving carriages, displacement of the impression cylinder receiving carriages (B1) located in the printing elements (1, 2, 3) and of the impression cylinder receiving carriages (A2) which are in a waiting position between the printing elements (1, 2, 3) takes place simultaneously and together in the opposite direction (g). With the execution of this pendulum-type displacement movement during the loading or unloading operation which takes place simultaneously for all the impression receiving carriages once in one longitudinal direction of the rotary printing machine and subsequently in the opposite longitudinal direction of the rotary printing machine, it is possible to carry out the exchange of the impression cylinder receiving carriages in a very rapid manner, and the possibility is provided also to carry out last-minute changes to the printing programme and, above all, to reduce the stoppage times of the printing machine to a minimum. Furthermore, it is possible to construct a rotary printing machine which is short in its longitudinal extent.

BRIEF DESCRIPTION OF THE DRAWINGS

The subject-matter of the invention is now described in more detail and illustrated in the attached drawings, in which.

DETAILED DESCRIPTION OF PREFERRED EMBODIMENT

Figure 1:
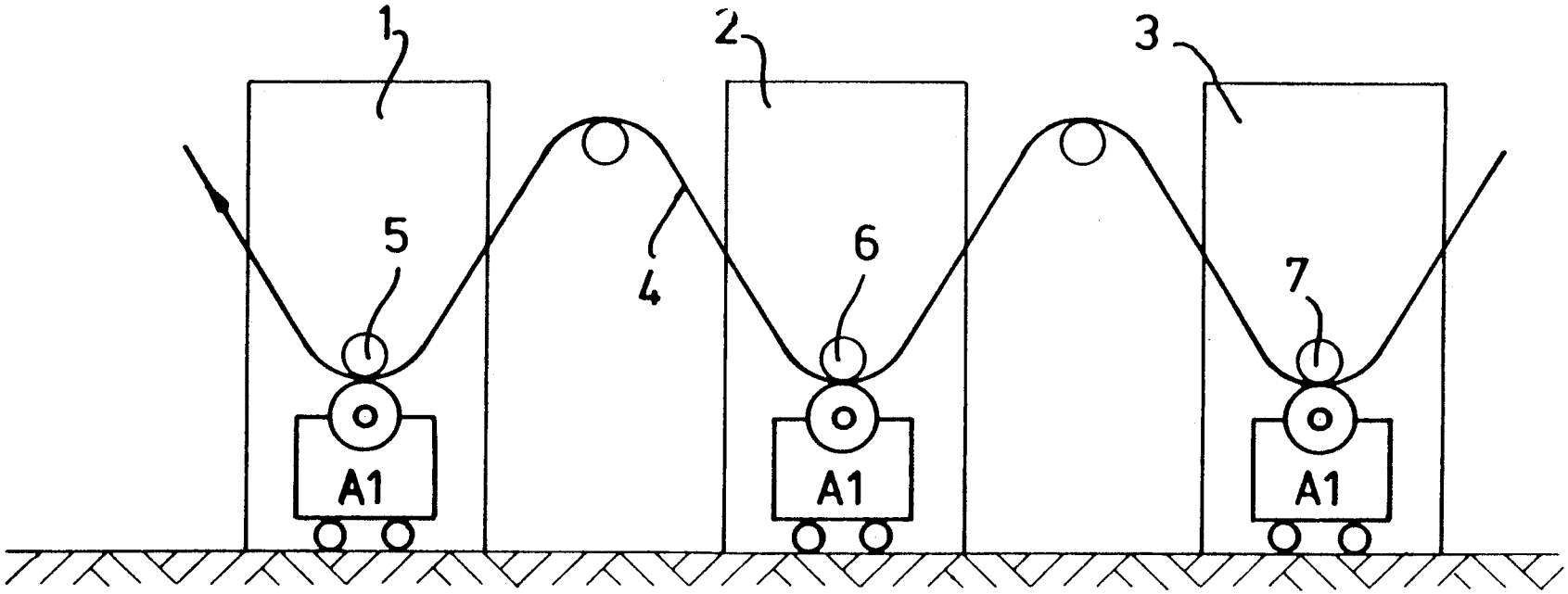
FIG. 1 shows three printing elements with the associated impression cylinder receiving carriages in the operating position.

As can be seen in FIG. 1, a web 4 to be printed passes through the printing elements 1, 2 and 3. An impression cylinder receiving carriage A1 is arranged in each printing element 1, 2, 3. Each receiving carriage A1 is fitted in a known manner with an impression cylinder. Furthermore, each carriage Al has a known squeegee device and a known ink application device.

Provided in each printing element 1, 2, 3 is a pressing roller 5, 6 and 7 respectively which can be raised and lowered and presses the web 4 against the impression cylinders of the receiving carriages A1. In FIG. 1, the rotary printing machine is illustrated diagrammatically during the printing operation.

Figure 2:
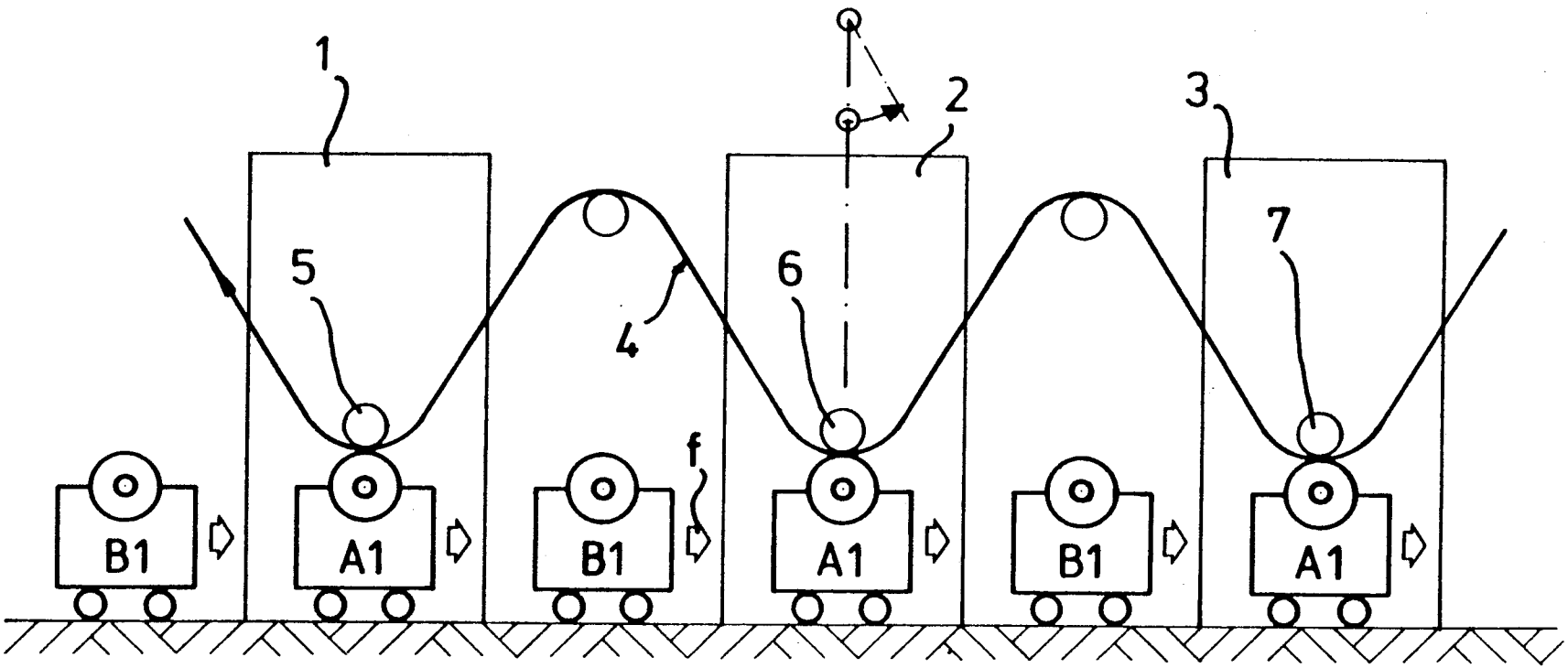
FIG. 2 shows the printing elements prior to the exchange of the impression cylinder receiving carriages.
Figure 3:
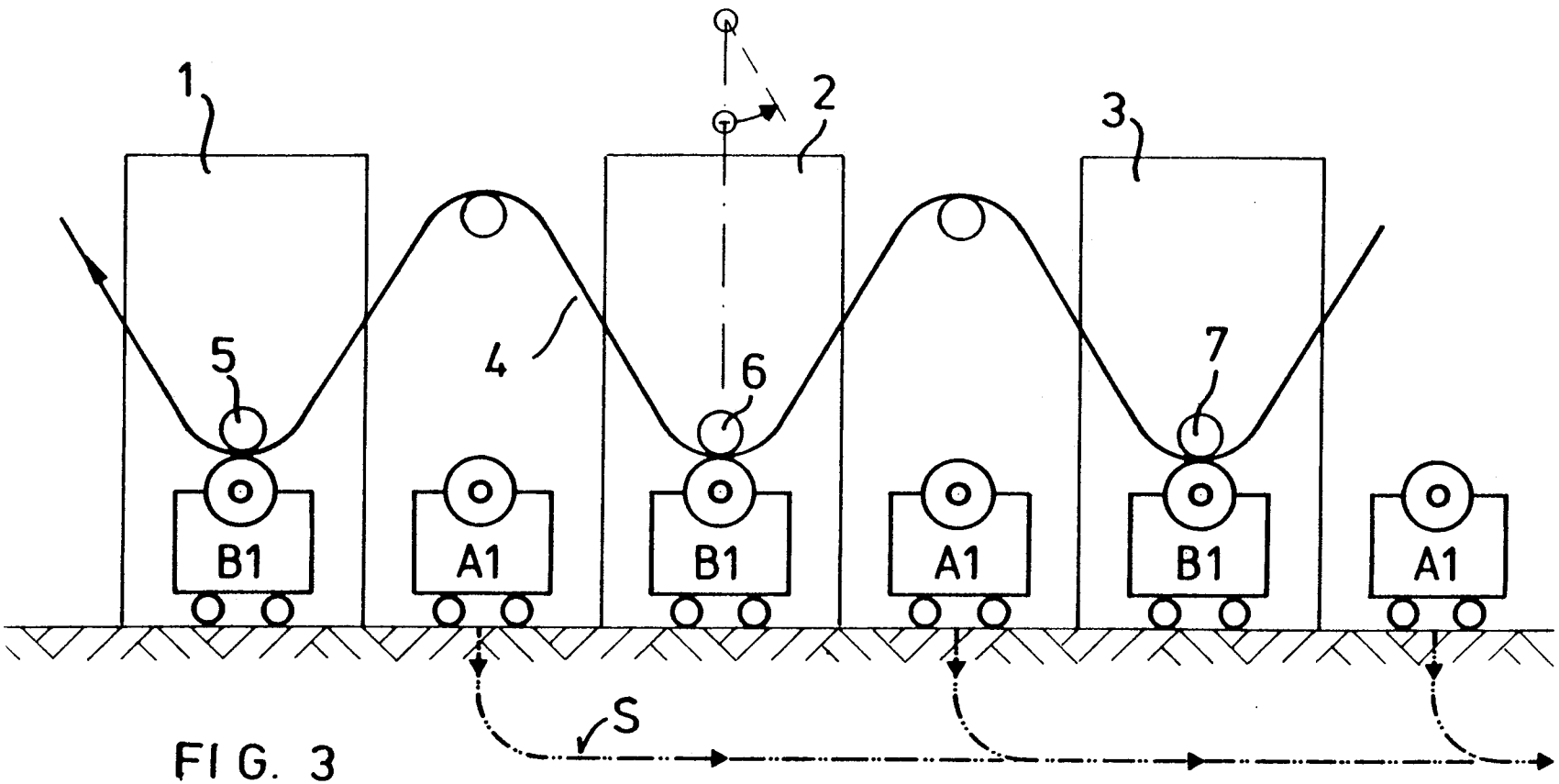
FIG. 3 shows the printing elements after the exchange of a first series of impression cylinder receiving carriages by means of carrying out a displacement movement in one longitudinal direction of the rotary printing machine.

As can be seen in FIG. 2, impression cylinder receiving carriages B1 which are in a waiting position are already being driven into the gaps formed in front of each printing element 1, 2, 3 during the printing operation in the printing elements 1, 2, 3 with the assistance of the impression cylinders held by the receiving carriages A1. In order to replace the carriages A1 by the impression cylinder receiving carriages B1 which are in a waiting position, the pressing cylinders 5, 6, 7 of each printing unit 1, 2, 3 are raised; subsequently, all the carriages A1, B1 are moved simultaneously and together and in the same displacement direction as indicated by the arrow f. In other words, the receiving carriages A1 and B1 are moved from left to right in the illustration according to FIG. 2.

The new receiving carriages B1 are thus caused to be driven into the printing elements 1, 2 and 3 and, simultaneously, all the receiving carriages A1 are moved into a gap which is arranged on the right side of the associated printing elements 1, 2 and 3.

This means that the receiving carriages B1 are immediately available for starting up the printing operation again, whereas the receiving carriages A1 can be transported away in the direction of the dot/dashed lines denoted by S.

Figure 4:
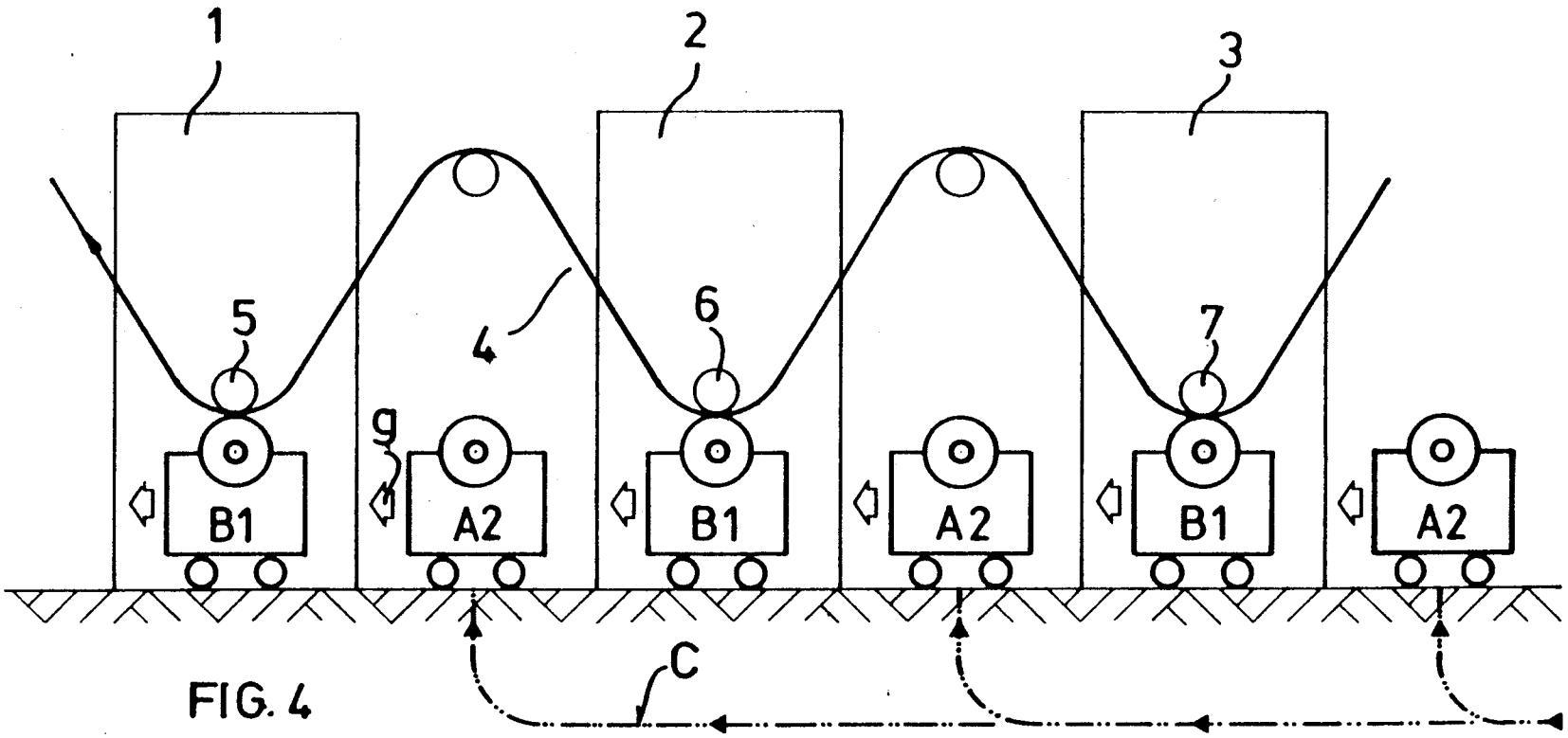
FIG. 4 shows three printing elements at the beginning of the exchange operation of the impression cylinder receiving carriages whilst carrying out a displacement movement in the opposite direction.

It can be seen in FIG. 4 that, while the impression cylinder receiving carriages B1 are in the operating position, new impression cylinder receiving carriages A2 are arranged along the displacement path C on the right side of the printing elements 1, 2 and 3 where these receiving carriages A2 remain in a waiting position. If exchange of the receiving carriages B1 by the receiving carriages A2 is to take place, the entire group of carriages B1 and A2 is displaced in the direction shown by the arrow g, that is to say from right to left. As a result, all the carriages B1 are driven out of the printing units 1, 2 and 3 simultaneously, whereas all the receiving carriages A2 are displaced into the interior of the printing units 1, 2 and 3 in order to be available there for the following printing operation.

Figure 5:
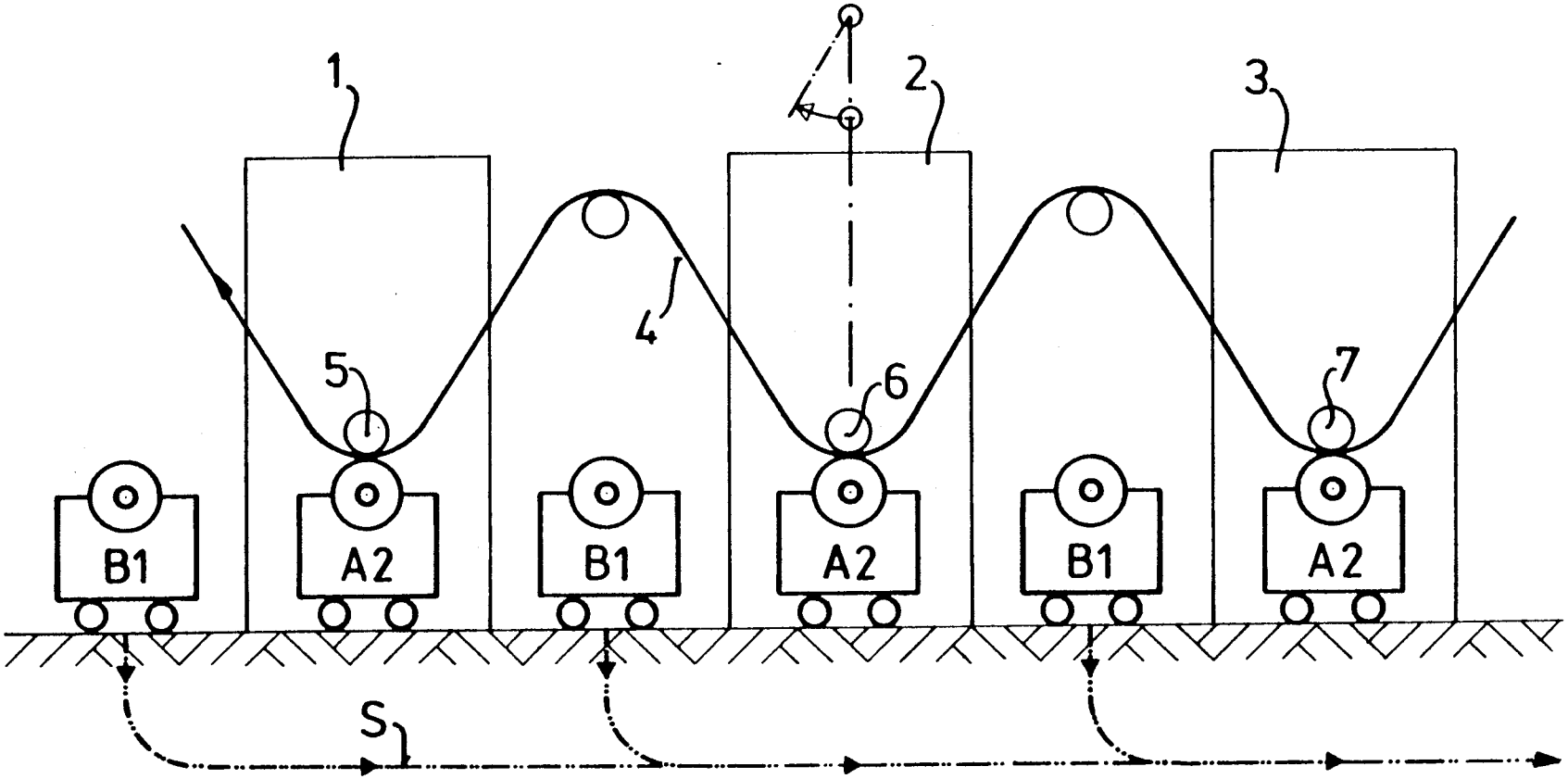
FIG. 5 shows the printing elements at the end of an exchange operation of the impression cylinder receiving carriage.

Subsequently, the receiving carriages B1 are driven away along the dot/dashed line S, as illustrated in FIG. 5.

Figure 6:
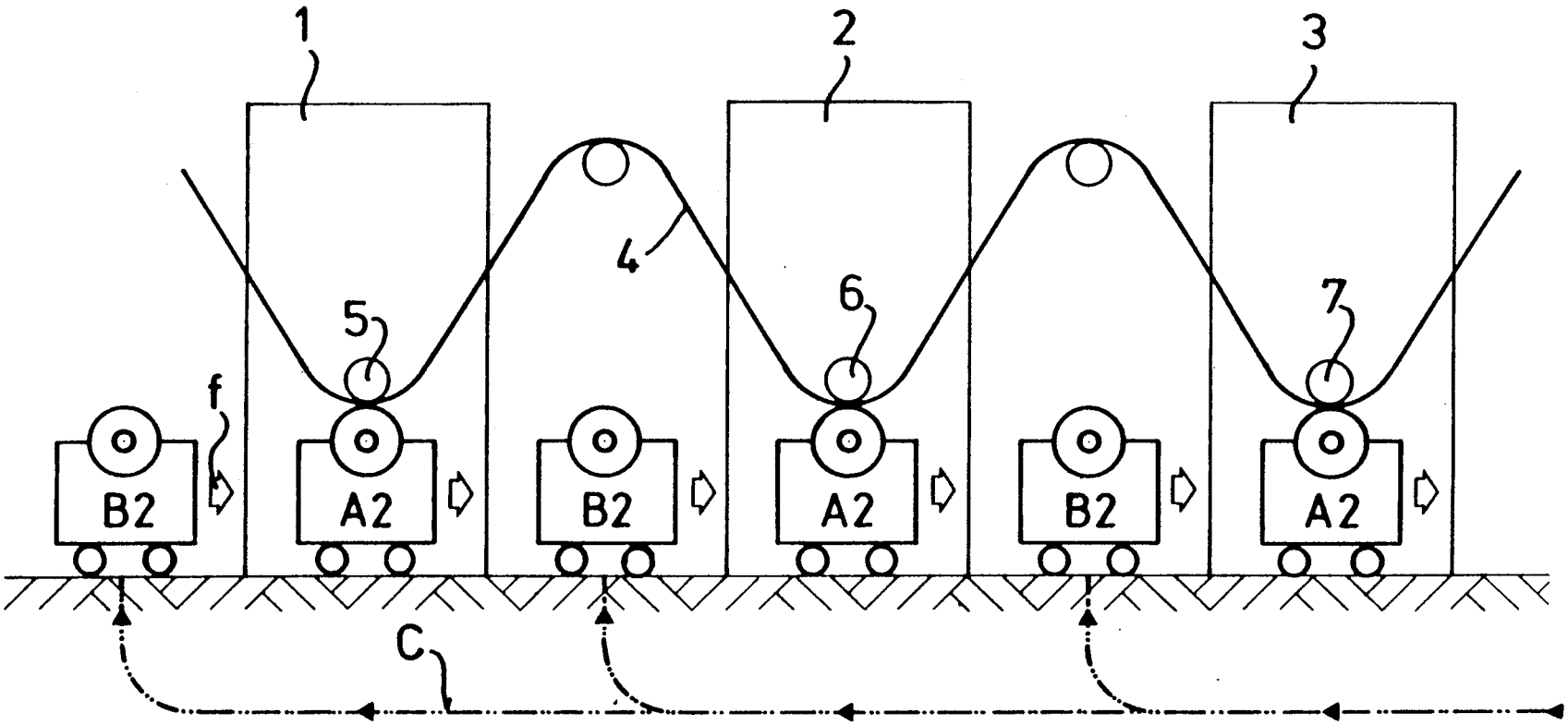
FIG. 6 shows the printing elements and the preparatory operations for carrying out a further carriage change.

As can be seen in FIG. 6, the gaps which have now formed on the left side of the printing units 1, 2 and 3 are occupied by new receiving carriages B2 which remain in a waiting position.

During the exchange of the receiving carriages A2, the entire group of carriages, consisting of the receiving carriages A2 and the receiving carriages B2, is again displaced in the direction of the arrow f, that is to say from left to right, whereupon the loading cycle is repeated.

The inventor has proposed that, during the exchange operation of the impression cylinder receiving carriages, the entire group of carriages (consisting of impression cylinder receiving carriages in the interior of the printing units 1, 2 and 3 and replacement carriages which are arranged in a waiting position in front of the printing units 1, 2 and 3) be displaced with a pendulum-type displacement movement once all together to the right and subsequently all together to the left; in this case, the inventor has noted that the equipment for controlling and for moving the receiving carriages can be of extremely simple construction.

It is possible with the invention to arrange all the control and drive devices for the impression cylinder receiving carriages above the floor on which the rotary printing machine is mounted, no interruptions in the floor, for example in the form of cutouts or channels, need to be provided. This is particularly advantageous considering the fact that leakages can also occur in a rotary printing machine due to loss of oil or escape of ink, which leakages can be removed more easily in the case of a floor of flat design.

I claim:

1. A method of changing impression cylinder carriages in printing units successively arranged, and spaced apart by predetermined spacings, along a longitudinal path in a rotary printing press directly supported on a flat floor, comprising the steps of:

a) positioning a first set of carriages on the floor within the units;

b) positioning a second set of replacement carriages on the floor in the spacings at downstream sides of the units;

c) replacing the first set with the second set of carriages by simultaneously moving both first and second sets on the floor only in an upstream direction along the path over the distance of one said spacing;

d) vacating the first set of carriages from the spacings at upstream sides of the units;

e) positioning a third set of replacement carriages on the floor in the spacings vacated by the first set at the upstream sides of the units;

f) replacing the second set with the third set of carriages by simultaneously moving both second and third sets on the floor only in a downstream direction along the path over the distance of one said spacing; and g) vacation the second set of carriages from the spacings at downstream sides of the units.

* * * * *